US006220950B1

(12) United States Patent
Novitsky

(10) Patent No.: US 6,220,950 B1
(45) Date of Patent: Apr. 24, 2001

(54) TOOL AND METHOD FOR IMPROVING ELECTRICAL CONDUCTING OF JACK CONNECTORS

(76) Inventor: Charles Novitsky, 7606 7th Ave., Brooklyn, NY (US) 11209

( * ) Notice: Subject to any disclaimer, the term of this patent is extended or adjusted under 35 U.S.C. 154(b) by 0 days.

(21) Appl. No.: 09/184,436

(22) Filed: Nov. 2, 1998

(51) Int. Cl.[7] ..... B24F 21/03

(52) U.S. Cl. ..... 451/558; 451/559; 15/104.04; 15/104.05; 15/106

(58) Field of Search ..... 439/931; 15/106, 15/118, 210.1, 211, 104.04–104.05, 104.16, 104.2, 104.001; 457/541, 552, 559, 558

(56) References Cited

U.S. PATENT DOCUMENTS 4,001,982 * 1/1977 Griffin et al. ..... 451/541
4,263,692 * 4/1981 Gremillion ..... 15/104.04
4,575,892 * 3/1986 Ross ..... 15/104.04
4,921,425 * 5/1990 Naghi ..... 451/558
4,993,100 * 2/1991 Halboth et al. ..... 15/210.1
5,144,775 * 9/1992 Bakanowsky, III ..... 451/558
5,515,571 5/1996 Grande .
5,970,559 * 10/1999 Christy ..... 15/106

* cited by examiner

*Primary Examiner*—Joseph J. Hail, III
*Assistant Examiner*—George Nguyen
(74) *Attorney, Agent, or Firm*—Roper & Quigg

(57) ABSTRACT

A tool for distributing electrically conductive particles, and optionally abrasive particles, on the surface of a male, electrical jack connector and a tool for distributing electrically conductive particles, and optionally abrasive particles, on the surface of a female, electrical jack connector which tools can be interfitted so that each acts as a removable cover for the other. The tools can simultaneously clean while distributing particles. A method for using each of the tools.

22 Claims, 1 Drawing Sheet

FIG. 1
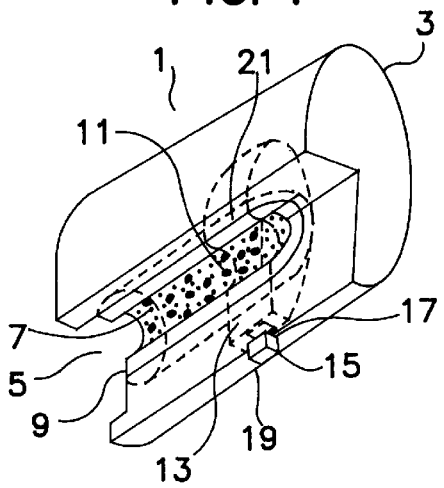
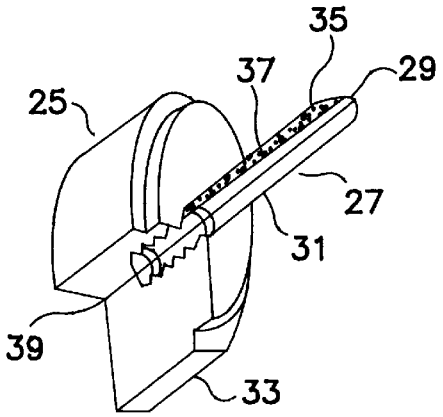
FIG. 2
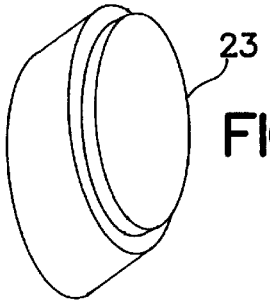
FIG. 3
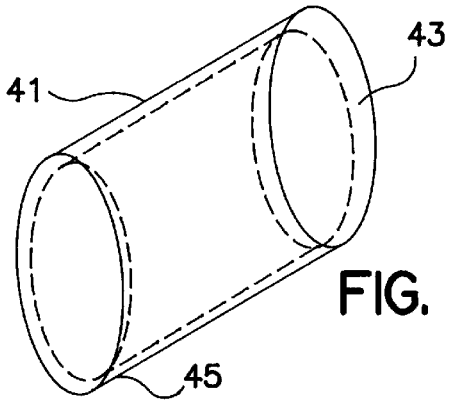
FIG. 4
FIG. 5
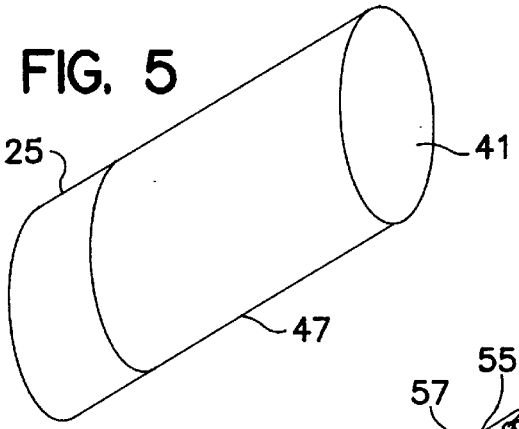
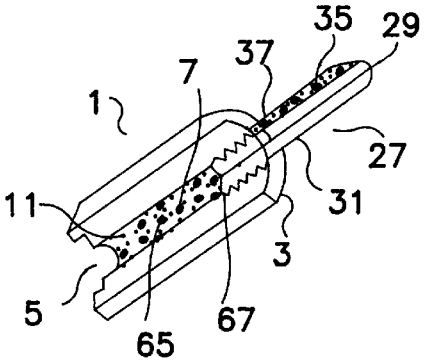
FIG. 7
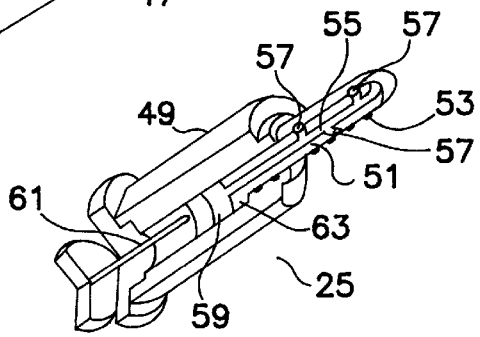
FIG. 6

TOOL AND METHOD FOR IMPROVING ELECTRICAL CONDUCTING OF JACK CONNECTORS

BACKGROUND OF THE INVENTION

1. Field of the Invention

This invention relates to the transmission of electrical signals. In one of its aspects it relates to jack connectors for transmission of electrical signals. In another of its aspects, it relates to improving transmission of electrical signals when jack connectors are used in the transmission of the signals. In another of its aspects, it relates to mechanically distributing particles on jack connectors. In yet another of its aspects, it relates to a tool for mechanically distributing particles on jack connectors. In more specific aspects of the invention it relates to a tool for distributing electrically conductive particles, abrasive particles and/or lubricant on the operating surface of an electrical jack connector and a method for effecting such distribution using a tool of this invention.

2. Description of the Prior Art

Electrical jack connectors are well known and of general use in the art. It is well known that both the male and the female components of jack connections eventually become coated with airborne grease and grime so that the conducting of electrical signals from the male to the female connector is impaired. Means and methods for cleaning connector components are known.

For instance U.S. Pat. No. 5,515,571 to Grande discloses a tool for cleaning a jack nose for sound powered telephone equipment in which an abrasive polishing wheel is mounted in a hollow tool body with the tool body and the polishing wheel having coaxial apertures into which a jack nose can be inserted. The polishing wheel can then be caused to rotate around the jack nose thereby abrasively removing material collected on the jack nose.

The Grande patent and the prior art cited therein provide means by which contacting ability of surfaces of both male and female connectors can be improved by cleaning of contact surfaces using, in general, abrasive surfaces or brush surfaces in communication with the surfaces to be cleaned.

Until the present invention the improvement of electrical contact between jack connectors seems to have depended entirely on tools and methods for cleaning their contact surfaces employing abrasive materials in the cleaning process or, more specifically, using abrasive materials as the surface of the cleaning tools.

3. Objects of the Invention.

It is therefore an object of this invention to provide a tool for improving the electrical contact between the contact surface of a jack connector and the connector surface with which it makes contact.

It is another object of this invention to provide a tool for applying electrically conducting particles to the contact surface of a jack connector.

It is still another object of this invention to provide a tool for simultaneously applying electrically conducting particles and abrasive particles to the contact surface of a jack connector.

It is still another object of this invention to provide a tool for applying lubricant along with electrically conducting particles and, optionally, abrasive particles to the contact surface of a jack connector.

It is another object of the invention to provide a method for improving the electrical contact between the contact surface of a jack connector and the connector surface with which it makes contact.

These and other objects and advantages of the present invention will become evident to those skilled in the art by reference to the following description and drawing and the appended claims.

SUMMARY OF THE INVENTION

According to this invention a tool is provided for distributing electrically conductive particles on the contact surface of an electrical jack connector.

Also according to this invention a tool is provided for simultaneously distributing electrically conductive particles and abrasive particles on the contact surface of an electrical jack connector.

Further, according to this invention a tool is provided for applying lubricant along with electrically conducting particles and, optionally, abrasive particles to the contact surface of a jack connector.

Further, according to this invention a method is provided for improving the electrical contact between the contact surface of a jack connector and the connector surface with which it makes contact.

BRIEF DESCRIPTION OF THE DRAWING

FIG. 1 is an isometric projection of a first tool for cleaning a male, electrical jack connector with one quarter of the first tool removed to disclose the interior of the first tool.

FIG. 2 is an isometric projection of a second tool for cleaning a female, electrical jack connector with one quarter of the second tool removed to disclose the interior of the second tool.

FIG. 3 is an isometric projection of a removable covering structure for protecting the contact surface of a first tool for cleaning a male, electrical jack connector.

FIG. 4 is an isometric projection of a removable covering structure for protecting the contact surface of a second tool for cleaning a female, electrical jack connector also showing the interior of the structure.

FIG. 5 is an isometric projection of a closed first tool of FIG. 1 and a second tool of FIG. 2 fitted together so that each serves as the removable covering structure for the other.

FIG. 6 is an isometric projection of a variation of a first tool having one quarter of the first tool removed to disclose the interior of the first tool and having a means for forcefully ejecting liquid associated therewith.

FIG. 7 is an isometric projection of a variation of a second tool which fits with the first tool of FIG. 6 and which has one quarter of the second tool removed to disclose the interior of the second tool.

In the various figures of the drawing, like items are assigned like numbers.

DETAILED DESCRIPTION OF THE INVENTION

According to a preferred embodiment of this invention a first tool is provided for distributing electrically conductive particles on the contact surface of a male, electrical jack connector. The components of the first tool are an enclosing structure suitable to be grasped between fingers and thumb with the enclosing structure containing an internal cylindrical opening having (a) a cylindrical contact surface portion geometrically compatible with the radial surface of a male, electrical, jack connector and (b) an end contact portion axially aligned with the cylindrical contact surface portion and geometrically compatible with the end portion of a male, electrical, jack connector. On the first contact surface and the end point contact surface of the first tool are particles that are conductive and at least some of the conductive particles are transferable from a surface of the first tool in contact with a contact surface of a male, electrical, jack connector.

According to a further embodiment of this invention there is provided a first tool for simultaneously cleaning a male, electrical, jack connector and distributing electrically conductive particles on the surface of the male connector. This first tool is a first tool as described immediately above in which there are not only electrically conductive particles but also particles that are abrasive on the contact surfaces of the first tool.

In a further embodiment of the invention, the enclosing structure of either the first tool suitable for distributing electrically conductive particles or the first tool suitable to simultaneously cleaning the surface of a connector and distributing electrically conductive particles thereon is provided with an internal chamber for containing lubricant. The chamber is accessible from outside the enclosing structure through a closable opening in the enclosing structure. Passage of lubricant, when present in the chamber, from the chamber to the internal cylindrical opening of the enclosing structure is provided through a porous section of the wall therebetween.

Referring now to FIG. 1, a first tool 1 for distributing electrically conductive particles on the contact surface of a male, electrical jack connector is constructed with an enclosing structure 3 that is molded in a form easily held between the thumb and fingers. The shape is illustrated here as a solid having an elongated oval cross section which is a shape easily grasped between the thumb and index finger or between the thumb and the tips of the fingers. The enclosing structure can, however, have any form that can be grasped, such as a cylinder, a rectangular solid, any solid having a regular geometric cross section, even a portion of a sphere, and the like.

Within the enclosing structure is a cylindrical opening 5 which is of sufficient length and diameter to allow insertion of a male, electrical, jack connector with sufficient tolerance to allow rotation of the first tool around the inserted jack connector. The cylindrical opening can be a hole bored in a matrix of plastic containing electrically conductive particles 7 with the matrix having been formed in the shell of the enclosing structure, the enclosing structure and the interior of the structure can be molded as a single solid object or, as illustrated here, the cylindrical opening can be a part of a replaceable insert 9 of a matrix of binder material, such as plastic, containing electrically conductive particles 7 that can be keyed into the enclosing structure.

The invention encompasses both having the particles embedded in the wall surface of the cylindrical opening and having the particles mechanically applied to the surface of the wall of the cylindrical opening as by mopping the interior with a solution containing particles or by pouring particles into the opening in which the interior surface has been coated with a material such as a lubricant grease that will retain particles along the surface and then shaking out excess particles that are not retained on the lubricant.

In a further embodiment of the invention not only electrically conductive particles but also abrasive particles 11 are embedded in the wall surface of the cylindrical opening or applied thereto as described above. The addition of abrasive particles allows removal of at least some of the electrical contact inhibiting, coating material, such as oxidation products, from the surface of the jack connector thereby providing a better chance of contact between the conducting particles and the surface of the jack. Optimally, the particles removed from the surface of the first tool onto the surface of the jack while rubbing the jack surface inside the cylindrical opening of the first tool are particles that are both abrasive and electrically conductive as in conductive particles of steel, copper, iron, carbon and the like. All of these materials can be pressed with known binder materials to form frangible surfaces for the tools of this invention or can be sprinkled onto the surfaces of the tools, with or without coating the surfaces with a binder, or retained on the surfaces, particularly of the tools for cleaning female jack connectors, by dipping the tool surfaces, with or without coating the surfaces with a binder, into a container of the conductive particles.

Graphite carbon is particularly useful as the particulate matter in the tools and processes of this invention because fine graphite particles are electrically conductive; can provide a fine, particulate coating that evens out irregularities on the surfaces treated; can, itself, serve as a lubricant on metal surfaces and, while hard enough to displace chemical corrosion products, is of sufficiently low abrasiveness that surfaces of electroplated, precious metals are not destroyed. As an added benefit, if oxidation of graphite deposited on the surface of the jack occurs, the oxidation product is a gas which departs from the surface without corrupting it.

In a further embodiment of the invention a pocket or chamber 13 is molded into the material filling the enclosing structure. The purpose of the chamber is to provide a containment for a lubricant liquid to be carried in the first tool. The lubricant can be introduced into the chamber through a port 15 molded in the side of the enclosing and connected to the chamber if necessary by a passageway 17. The port is closed with a plug 19 that fits snugly into the port and can be removed with a flick of a fingernail or other thin prying device. The lubricant used is chosen to have a viscosity sufficient allow it to pass from the chamber through a porous section 21 of the molded wall onto the cylindrical contact surface of the first tool.

When not in use the operating surface of the first tool is protected by a removable structure, i.e. a slip-on cover, which, as illustrated in FIG. 3, can be a cap 23 that snaps onto the end of the first tool or which, among others, can be a simple, geometrically compatible lid having and end section connected to a portion that slides over the end of the first tool for a distance sufficient to maintain the cover in place.

In operation, the cap 23 is removed from the first tool. The male, jack connector to be treated is inserted into the handheld first tool 1 and the first tool is rotated with alternate clockwise and counterclockwise motions around the connector which is held stationary. Some of the electrically conductive particles 7 either embedded in or adhered onto the interior surface of the first tool are transferred to the surface of the connector thereby improving the electrical conducting of the connector. If abrasive particles 11 are present, the operative motion transfers some of the abrasive particles onto the surface of the connector and simultaneously with the rubbing together of the two surfaces provides a cleaning action on the surface of the connector. At the end of the rubbing action, on disengagement of the first tool and jack connector, some of the electrically conductive particles as well as 'some of the abrasive particles will remain on the surface of the jack connector. On disengagement the cover is reapplied to the first tool.

When the first tool is provided with an internal lubricant chamber 13 there is sufficient passage of the lubricant through the porous wall 21 onto the operational surface of the wall of the cylindrical opening to provide adherence of particles introduced from outside of the first tool to the surface of the cylindrical opening. When the lubricant chamber is not present or not used, lubricant can be swabbed onto the surface of the cylindrical opening if desired.

When the operative interior of the first tool is sufficiently worn that the desired transfer of particles no longer occurs, the embodiment of the invention illustrated shows that the first tool can be provided with an insert portion that can be replaced as desired. The insert can be held in place during operation by a key and keyway combination with either on the first tool and the matching device on the insert or the insert and the aperture in which it is fitted can have a cross section other than round.

According to another preferred embodiment of the invention, referring now to FIG. 2, a second tool 25 is provided for distributing electrically conductive particles on the interior surface of a female, electrical, jack connector. The components of the second tool are (A) an elongated contact portion 27 having (1) an end contact, surface portion 29 geometrically compatible with the interior of a female, electrical, jack connector with this end contact, surface portion 29 attached to (2) a radial contact, surface portion 31 co-axially aligned with the end contact, surface portion; geometrically compatible with the interior surface of the female, electrical, jack connector and attached to (B) a gripping portion 33. On the end and radial contact surfaces of the second tool are particles that are conductive and at least some of the conductive particles 35 are transferable from a surface of the second tool in contact with a contact surface of a female, electrical, jack connector.

According to a further embodiment of this invention there is provided a second tool 25 for simultaneously cleaning a female, electrical, jack connector and distributing electrically conductive particles on the surface of the female connector. This second tool is a second tool as described immediately above in which there are not only electrically conductive particles but also particles that are abrasive 37 on the contact surfaces of the second tool.

Still referring now to FIG. 2, a second tool 25 for distributing electrically conductive particles on the contact surface of a female, electrical jack connector is constructed with a molded, gripping structure 33 that is molded in a form easily held between the thumb and fingers. The shape is illustrated here as a solid having an elongated oval cross section which is a shape easily grasped between the thumb and index finger or between the thumb and the tips of the fingers. The gripping structure can, however, have any form that can be grasped, such as a cylinder, a rectangular solid, any solid having a regular geometric cross section, even a portion of a sphere, and the like.

In a preferred embodiment of the invention the portion of this second tool that contains the end contact portion 29 and the radial contact, portion 31 is a support shaft 23 onto which is molded a matrix of plastic containing electrically conductive particles 35. The shaft extends from the contact surface portions into the grasping structure for a length that is sufficient to maintain it in operative position. The portion of the shaft that extends into the grasping structure is sized to fit securely into a cylindrical hole in the grasping structure and preferably the shaft and the cylindrical hole 39 in the grasping structure are fitted with a key and keyway combination with either key or keyway on the shaft of the second tool and the matching device in the cylindrical hole in the grasping structure or the shaft and the hole into which it fits can have matching cross sections of any geometrical shape except circular or the hole in the grasping structure can be tapped for receiving the shaft which has a matching screw section cut thereon. Any of these expediencies allows substitution of new shaft for a worn shaft with minimal effort.

The invention encompasses both having the particles embedded in the contact surface portions of the shaft and having the particles mechanically applied to the contact surface portions of the shaft as by mopping the surface portions with a solution containing particles or by pouring particles onto the surfaces that have been coated with a material such as a lubricant grease that will retain particles along the surface and then shaking off excess particles that are not retained on the lubricant.

In a further embodiment of the invention not only electrically conductive particles 35 but also abrasive particles 37 are embedded in the contact surfaces or are applied thereto as described above. The addition of abrasive particles allows removal of at least some of the electrical contact inhibiting, coating material, such as oxidation products, from the surface of the jack connector thereby providing a better chance of contact between the conducting particles and the surface of the jack. Optimally, the particles removed from the surface of the second tool onto the surface of the jack while rubbing the jack surface inside the cylindrical opening of the second tool are particles that are both abrasive and electrically conductive as in conductive particles of steel, copper, iron, carbon and the like. All of these materials can be applied to the tools of this invention as discussed above with graphite carbon being the preferred, particulate material.

When not in use the operating surface of the second tool is protected by a removable structure, i.e. a slip-on cover, which, as illustrated in FIG. 4, can be a lid that snaps onto the end of grasping section of the second tool or which, among others, can be a simple, geometrically compatible cap 41 having and end section 43 connected to a side portion 45 that slides over the end of the grasping section of the second tool for a distance sufficient to maintain the cover in place.

In operation, the cap 41 is removed from the second tool. The shaft 27 of the second tool 25 is inserted into the female, jack connector to be treated and the second tool is rotated with alternate clockwise and counterclockwise motions within the connector which is held stationary. Some of the electrically conductive particles 35 either embedded in or adhered onto the contact surfaces of the second tool are transferred to the surface of the connector thereby improving the electrical conducting of the connector. If abrasive particles 37 are present, the operative motion transfers some of the abrasive particles onto the surface of the connector and simultaneously with the rubbing together of the two surfaces provides a cleaning action on the surface of the connector. At the end of the rubbing action, on disengagement of the second tool and jack connector, some of the electrically conductive particles as well as some of the abrasive particles will remain on the surface of the jack connector. On disengagement the cover is reapplied to the second tool.

In the most preferred embodiment of the invention, as shown in FIG. 1, a first tool 1 for simultaneously cleaning and distributing electrically conductive particles on the surface of a male, electrical jack connector and a second tool 25 for simultaneously cleaning and distributing electrically conductive particles on the surface of a female, electrical jack connector as shown in FIG. 3 are sized to interfit in a closed position, when not in operation, so that each of the particle distribution devices, as shown in FIG. 5, acts as a removable structure to protect the contacting surface of the other particle distribution tool thereby forming a closed, combination device 47.

Referring to FIG. 6, a variation of the second tool 25 is shown that has the basic structure of an elongated contact portion 27 embedded in a screwdriver-like handle 49. The coating on the elongated contact portion can be sufficiently frangible that particulate matter is removed from its surface during the treatment of the jack connector or particulate matter can be added to the surface before the treatment is begun. The elongated contact portion can be replaceable as illustrated in FIG. 2.

In the second tool 25 of FIG. 6 the elongated contact portion 27 is shown as a metal rod 51 coated with graphite 53 held together and on the rod by a plastic binding material. The graphitic coating is porous and the metal rod is hollow to provide a chamber 55 therein with small openings 57 from this chamber of the metal rod to the rod surface in contact with the porous, carbonaceous coating. This chamber of the elongated contact portion and a larger chamber 59 in the handle 49 serve as a reservoir for liquid, such as a lubricant or cleaning liquid, which can be urged from the chamber through the small openings and the porous coating by a plunger mechanism 61 that fits within the rod. Such a plunger and its operation are well known. It can be as simple as a rod-like plunger operated with a thumb, a common hypodermic arrangement with finger grasps and thumb operation or a more elaborate screw operation, among others.

For an arrangement using a hollow elongated contact portion and plunger, a replaceable elongated contact portion must be anchored in the gripping portion so that it will not be pushed out by the action of the plunger. This is most easily accomplished by screwing the elongated contact portion into the gripping portion or by using an elongated contact portion having an enlarged shoulder 63 insertable from the posterior side through the cylindrical hole, that in this embodiment of the invention extends all the way through the gripping portion, with an offset at the posterior of the cylindrical hole sized to retain the shoulder on the elongated contact portion behind the cylindrical hole in the gripping portion.

Referring now to FIG. 7, this variation of the first tool 1, as described in this figure, has all the attributes of the tool of FIG. 1 with the exception of the chamber for containing lubricant which the relatively small diameter of the tool of FIG. 7 does not easily accommodate. In addition, this tool incorporates from the second tool 25, as shown in FIG. 2, an elongated contact portion 27 having (1) an end contact, surface portion 29 geometrically compatible with the interior of a female, electrical, jack connector with this end contact, surface portion 29 attached to (2) a radial contact, surface portion 31 co-axially aligned with the end contact, surface portion; geometrically compatible with the interior surface of the female, electrical, jack connector and attached to the first tool 1 which serves as a gripping portion. The end contact, surface portion and the radial contact, surface portion can be coated with conductive particles 35 and abrasive particles 37 or the particles can be both conductive and abrasive.

This variation of a first tool/second tool combination has an enclosing structure 3 suitable to be grasped between fingers and thumb. The enclosing structure contains an internal cylindrical opening 5 that has (a) a cylindrical, contact surface portion 65 geometrically compatible with the radial surface of a male, electrical, jack connector and (b) an end contact portion 67 axially aligned with the cylindrical contact surface portion and geometrically compatible with the end portion of a male, electrical, jack connector. The cylindrical, contact surfaces and the end point contact surfaces of this combination first tool/second tool comprise particles 7,11 that are electrically conductive 7,35 and, optionally, abrasive 11,37 and in operative contact with a contact surface of an electrical, jack connector at least some of the particles are transferable to that surface.

It should be noted that the portion of the portion of the tool shown in FIG. 7 encompassed by the enclosing structure 3 but without the elongated contact portion 27 can serve as an interfitting cover for the device illustrated in FIG. 6.

The tools of this invention can be sized to accommodate electrical jack connectors of any dimensions. It should be apparent that a close fit between the tool and the connector is an aid to operating the invention, but that there must be sufficient tolerance between the operating surfaces of the tool and the connector to allow conductive particles to be transferred from the tool to the connector.

The invention thus being described, it will be obvious that the invention can be varied in many ways. Such variations are not to be regarded as a departure from the spirit and scope of the invention and all such modifications are intended to be included within the scope of the following claims.

That which is claimed is:

1. A first tool for distributing electrically conductive particles on the contact surface of a male, electrical jack connector said first tool comprising an enclosing structure suitable to be grasped between fingers and thumb, said structure containing an internal cylindrical opening having (a) a cylindrical, contact surface portion geometrically compatible with the radial surface of a male, electrical, jack connector and (b) an end contact portion axially aligned with the cylindrical contact surface portion and geometrically compatible with the end portion of a male, electrical, jack connector, wherein the cylindrical, contact surface and the end point contact surface of the first tool comprise particles that are conductive and wherein at least some of the conductive particles are transferable from a surface of the first tool in contact with a contact surface of a male, electrical, jack connector.

2. A first tool for simultaneously cleaning a male, electrical, jack connector and distributing electrically conductive particles on the contact surface of the male connector said first tool comprising the first tool of claim 1 wherein the cylindrical contact surface and the end contact surface of the first tool comprise particles that are abrasive.

3. A first tool according to claim 2 wherein at least some of the abrasive particles are transferable from a contact surface of the first tool in contact with a contact surface of a male, electrical, jack, connector.

4. A first tool according to claim 1 wherein the enclosing structure contains a chamber for containing lubricant within the chamber and wherein the chamber is accessible through a closable opening from outside the enclosing structure and passage of lubricant, when present, from the chamber to the internal cylindrical opening is provided through a porous section of wall therebetween.

5. A first tool according to claim 2 wherein the enclosing structure contains a chamber for containing lubricant within the chamber and wherein the chamber is accessible through a closable opening from outside the enclosing structure and passage of lubricant, when present, from the chamber to the internal cylindrical opening is provided through a porous section of wall therebetween.

6. A first tool according to claim 3 wherein the enclosing structure contains a chamber for containing lubricant within the chamber and wherein the chamber is accessible through a closable opening from outside the enclosing structure and passage of lubricant, when present, from the chamber to the internal cylindrical opening is provided through a porous section of wall therebetween.

7. A first tool according to claim 1 wherein the contact surfaces of the first tool are protected by a removable structure.

8. A first tool according to claim 2 wherein the contact surfaces of the first tool are protected by a removable structure.

9. A first tool according to claim 3 wherein the contact surfaces of the first tool are protected by a removable structure.

10. A first tool according to claim 4 wherein the contact surfaces of the first tool are protected by a removable structure.

11. A first tool according to claim 5 wherein the contact surfaces of the first tool are protected by a removable structure.

12. A first tool according to claim 2 wherein carbon particles are present as the conductive and abrasive particles.

13. A second tool for distributing electrically conductive particles on the interior, contact surface of a female, jack connector said second tool comprising:

(A) an elongated, contact portion having (1) an end contact, surface portion geometrically compatible with the interior, end portion of the female, electrical, jack connector with the end contact, surface portion attached to (2) a radial contact, surface portion geometrically compatible with the interior, contact surface of the female, electrical, jack connector with the radial contact, surface portion attached to (B) a gripping portion;

wherein the radial contact surface and the end portion contact surface of the second tool comprise particles that are electrically conductive wherein at least some of the conductive particles are transferable from a surface of the second tool in contact with an interior, contact surface of an electrical jack, female connector.

14. A second tool for simultaneously cleaning the interior of an electrical jack, female connector and distributing electrically conductive particles on the interior, contact surface of the jack, female connector said second tool comprising the second tool of claim 13 wherein the radial contact surface and the end portion contact surface of the second tool comprise particles that are abrasive.

15. A second tool according to claim 13 wherein the elongated contact portion contains a chamber for containing lubricant within the chamber and wherein the chamber is accessible through a closable opening from outside the enclosing structure and passage of lubricant, when present, from the chamber to the internal cylindrical opening is provided through a porous section of wall therebetween.

16. A second tool according to claim 14 wherein at least some of the abrasive particles are transferable from a surface of the second tool in contact with an interior, contact surface of an electrical jack, female connector.

17. A second tool according to claim 13 wherein the contact surfaces of the second tool are housed in a removable structure.

18. A second tool according to claim 14 wherein the contact surfaces of the second tool are housed in a removable structure.

19. A second tool according to claim 15 wherein the contact surfaces of the second tool are housed in a removable structure.

20. A second tool according to claim 14 fitted into a first tool for distributing electrically conductive particles on the contact surface of a male, electrical jack connector said first tool comprising an enclosing structure suitable to be grasped between fingers and thumb, said structure containing an internal cylindrical opening at a first end and the second tool at a second end with said first tool having (a) a cylindrical, contact surface portion geometrically compatible with the radial surface of a male, electrical, jack connector and (b) an end contact portion axially aligned with the cylindrical contact surface portion and geometrically compatible with the end portion of a male, electrical, jack connector, wherein the cylindrical, contact surface and the end point contact surface of the first tool comprise particles that are conductive and particles that are abrasive wherein at least some of the particles are transferable from a surface of the first tool in contact with a contact surface of a male, electrical, jack connector.

21. A second tool according to claim 14 wherein carbon particles are present as the conductive and abrasive particles.

22. A first tool and a second tool according to claim 20 wherein carbon particles are present as the conductive and abrasive particles.

* * * * *